United States Patent [19]

Battle

[11] Patent Number: 4,739,569

[45] Date of Patent: Apr. 26, 1988

[54] FIREARM SAFETY RELEASE WARNING INDICATOR

[76] Inventor: Harold P. Battle, 25 Winyah Ter., New Rochelle, N.Y. 10801

[21] Appl. No.: 17,809

[22] Filed: Feb. 24, 1987

[51] Int. Cl.[4] ..... F41C 17/00

[52] U.S. Cl. ..... 42/1.01; 42/70.01

[58] Field of Search ..... 42/1.01, 70.01, 70.04, 42/70.05, 70.06

[56] References Cited

U.S. PATENT DOCUMENTS

| | | | |
|---|---|---|---|
| 666,405 | 1/1901 | Baggett | 42/1.01 |
| 2,134,406 | 10/1938 | Jacobs | 42/1.01 |
| 3,044,204 | 7/1962 | Zimmerman | 42/1.01 |
| 3,842,526 | 10/1974 | Dixon | 42/1.01 |
| 4,007,553 | 2/1977 | Clegg | 42/1.01 |
| 4,476,644 | 10/1984 | Laing | 42/1.01 |

*Primary Examiner*—David H. Brown
*Assistant Examiner*—Michael J. Carone
*Attorney, Agent, or Firm*—Darby & Darby

[57] ABSTRACT

The release of the safety button of a firearm is indicated by the lighting of a lamp and/or the sounding of a buzzer. Movement of the safety button is detected by a resiliently positioned coil of wire which acts as a switch contact to supply electrical energy from a battery to the indicator upon release of the safety.

5 Claims, 1 Drawing Sheet

FIREARM SAFETY RELEASE WARNING INDICATOR

TECHNICAL FIELD

This invention relates to firearm safety devices and, more particularly, to electrically powered visual or audio indications of the release of a firearm safety.

BACKGROUND ART

It is easily recognized that firearms are extremely and inherently dangerous. Little can be done to minimize their hazard without impairing their effectiveness. Besides cautious use, the firearm safety is practically the only means of preventing accidental discharge of the weapon.

In its most common form the safety is a mechanical latch or button, which in one position blocks the movement of the trigger and keeps the firearm from operating. Usually the position of the latch or button indicates to the user whether the weapon can be fired. However, this indication is less than positive and certain. Consequently, a person who is not familiar with the weapon may not know the position which indicates that the safety is effective. Thus, someone using a new gun or someone accompanying another person who has a gun, may not be fully aware of whether the safety is on or off. If the safety is off, the firearm may be accidentally discharged if the firearm strikes against some solid object, thus injuring the user or someone with him.

It would be a significant advance in weapon safety if a positive and unambiguous indication were provided when the safety was off and the weapon could be fired. Thus the user would know for sure when the safety was off if he looked at the indicator and would even be drawn to note the condition of the safety.

DISCLOSURE OF THE INVENTION

The present invention is directed to providing an unambiguous indication of when a firearm safety is off, by including a safety release wearing indicator lamp or buzzer on the firearm.

In an illustrative embodiment of the invention the stock of a firearm is provided with a hollow cavity in which a battery is located. This battery has one terminal connected by insulating wire to one terminal of an indicator lamp which is positioned along the upper surface of the firearm in the region of, but below, the normal sight position. The other terminal of the lamp is connected to the metal trigger housing of the weapon. A generally insulated wire also extends to the vicinity of the metal safety lever or button. This wire extends from the firearm to a position where it is in contact with the safety when the safety is in the released position. At least a part of the wire which extends from the weapon is uninsulated and is relatively rigid such that it is resiliently held in position.

When the safety is released, the metal safety lever or button and the rigid exposed wire act as a closed electrical switch which allows electrical current from the battery to flow through the indicator lamp and to light it. As a result the lamp will be on whenever the safety is off, and both the user and those traveling with him will readily appreciate that the light is on.

Since there will be a natural desire on the part of the user to keep the battery from running down, and to turn the light off, the user will be prompted to keep the safety on until the weapon must actually be fired. In a preferred embodiment, the indicator will also include a delay activated buzzer or other audio alarm. This audio alarm does not sound as soon as the safety is release because the sound might frighten away game being hunted. However, if the safety remains off for a period of time, e.g. a minute, the buzzer sounds to warn that the safety is off and to prompt the user to put it on.

BRIEF DESCRIPTION OF THE DRAWINGS

The foregoing and other features of the present invention will be more readily apparent from the following detailed description and drawings of an illustrative embodiment of the invention in which.

DESCRIPTION OF AN ILLUSTRATIVE EMBODIMENT

Figure 1:
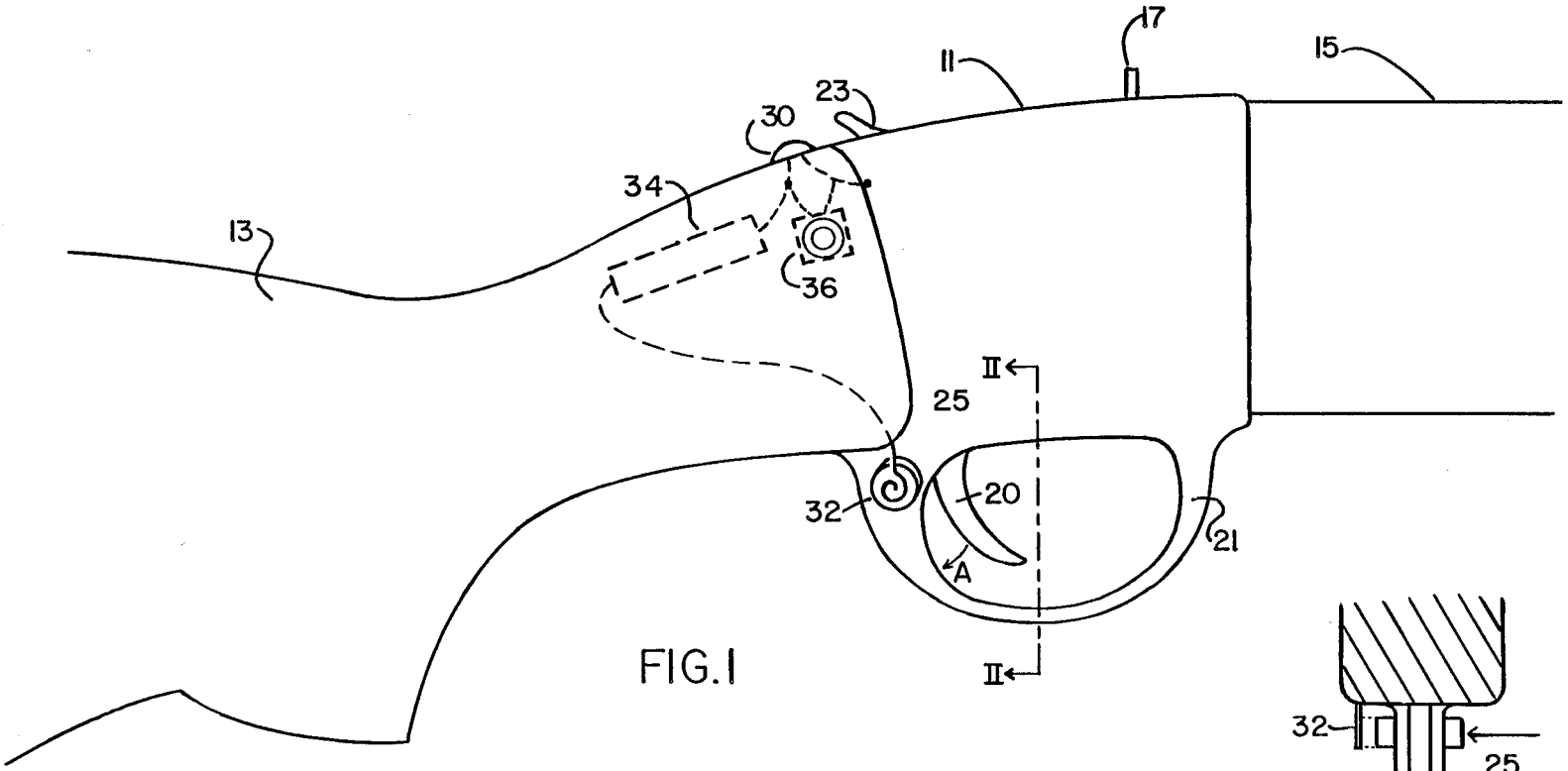
FIG. 1 is a side view of a rifle equipped with the present invention.

In FIG. 1 there is shown the center portion of a rifle including the metal trigger housing 11, the stock portion 13 and the barrel assembly 15. One portion of a sight 17 is positioned on the trigger housing and is used to aim the weapon in conjunction with another sight located at the end of barrel 15 (not shown). While a rifle is shown, it should be clearly understood that the present invention can be adapted for use with shotguns, revolvers, cross-bows and other similar weapons.

Located within the trigger housing 11 of a conventional weapon is the trigger 20 which is typically surrounded by a trigger guard 21. Operation of the trigger is effected by pulling the trigger in the direction shown by arrow A. This causes the hammer, a portion of which is indicated at 23, to draw back and then to snap forward against a cartridge in the weapon. This causes the weapon to discharge. As is well known, this operation can be prevented through the use of a safety, which mechanically prevents the squeezing of the trigger 20. In order to set this mechanical stop in place, a safety lever or button 25 is moved into an on position. As a result, the weapon cannot be used until the safety button is moved into its off or release position.

Figure 2:
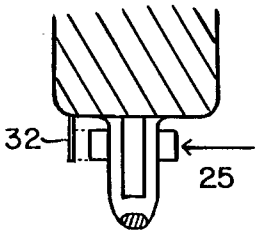
FIG. 2 is a sectional view of the rifle of FIG. 1 along line II—II.

In many weapons, such as the one illustrated in FIG. 1, the safety is on when the button is pushed in one direction, for example, to the right as shown in FIG. 2, and is off or released when the button is pushed to the left, as shown by arrow B in FIG. 2. However, the user of the weapon must remember which position of safety button 25 indicates a release of the safety. There is no positive indication of this. However, there are prior devices in which a color code is used on the safety button or lever to assist the user in knowing whether the safety is on or released.

According to the present invention, a much more positive indication of the release of the safety is provided. In particular, a lamp 30 is arranged to light whenever the safety is released. This lamp 30 is located on the upper surface of the rifle along the line that one would sight in aiming the weapon. It is located in this position so that it can be readily observed by someone aiming the weapon. Also, it is standard for a person to carry the weapon such that this upper surface is visible. Further, the protruding nature of the lamp allows it to be viewed from the side, so that people accompanying the person carrying the weapon will also be able to easily see when the safety has been released and can warn the user.

A difficulty in using an electrical indication, such as the lamp 30, to tell when the safety has been released, is that there is no physical change in electrical conductivity during the release of the safety. The safety button 25 is metal and is in intimate contact with the trigger housing 11. Thus, there is electrical continuity between the trigger housing and the button regardless of the position of the safety button 25. This problem, however, has been overcome by the present invention by the creation of a safety release detector switch.

The safety release detector switch is formed by an exposed piece of wire 32 which projects from the stock into a position where it is engaged by the trigger button 25 when the safety is released, i.e. pushed to its released position in the direction of arrow B shown in FIG. 2. This wire 32 must be relatively rigid, but resilient, such that it maintains good electrical contact with the safety button and is not bent out of contact with it through repeated use. As a result, in the released position there is electrical contact between the safety button and exposed wire 32, but when the safety is on there is no contact between these two members.

Wire 32 or an extension thereof is insulated from the housing 11 and extends through the stock 13 to a source of electrical energy, such as battery 34. The other terminal of this battery extends to one terminal of lamp 30, and the other terminal of lamp 30 extends to the trigger housing 11. Since the trigger housing is in intimate electrical contact with the safety button, there is a series electrical circuit that includes the release detector switch formed by safety button 25 and wire 32, the battery 34, the lamp 30 and the trigger housing 11. Consequently the lamp 30 lights when the safety button is pushed in the direction of arrow B in FIG. 2. When the button is moved in the opposite direction the circuit is broken and the lamp goes out.

While it is possible to have a single straight piece of wire for making contact with safety button 25, it has been found that better contact is achieved if more metal surface area is provided in wire 32. As a result, in a preferred embodiment, wire 32 has a coil of wire at its end, as shown in FIG. 1, for making contact with the button 25.

The visual indication of a released safety from lamp 30 is a significant advance over the prior art, because it gives a positive indication of safety release which is visible to the user and those accompanying him. In addition, it encourages the user to keep the safety on to avoid the annoyance of the light and the possibility of running down the battery 34. Nevertheless, in the midst of a hunting expedition even this visual indication may be ignored. Thus, a backup indication of the release of the safety is provided in the form of a delayed buzzer 36 which is connected in parallel across lamp 30. When the voltage from battery 34 is applied across lamp 30, the same voltage is applied across delayed buzzer 36. This causes the buzzer to begin a timing sequence, for example, about 60 seconds. At the end of the timing sequence the buzzer is activated. The delay is provided such that the release of the safety, just at a time when the weapon is to be discharged at game, will not cause the buzzer to sound, which might frighten the game and cause the user to miss his target. Thus, a period of about 60 seconds is given for the user to complete the shot. If the shot is not completed in that time period, the buzzer begins to sound as an indication that the safety should be put on again. This is particularly important because a user in close proximity to game may become so engrossed in the hunt that he fails to notice that the safety has remained in the off condition. The sound from the buzzer 36 will make him immediately and positively aware that the safety has not been restored.

While the invention has been in particularly shown and described with reference to a preferred embodiment thereof, it would be understood by those skilled in the art that various changes in form and detail made be made therein without departing from the spirit and scope of the invention.

I claim:

1. A safety indicator for a weapon having a metal housing part in which a movable metal safety member is positioned, said safety member being movable between a release position in which the safety is disengaged and an engaged position in which the safety member is engaged and the weapon will not operate, comprising:

an indicator means mounted on the weapon along an upper surface thereof, when in the normal horizontal firing position, for producing an indication whenever it is activated by electrical energy, said indicator means further includes a delay means that produces an electrical delay signal a predetermined period after the indicator means is activated, and an alarm that is activated in response to the electrical delay signal;

a source of electrical energy;

a safety release detector switch located adjacent the safety of the weapon, said detector switch including said safety member and a first resilient wire which is in electrical contact with the safety member when the safety member is in the release position and is out of contact with the safety member when it is in the engaged position, and a second wire connected to said metal housing, said first wire being insulated from said housing, said detector switch, indicator means, source of electrical energy and metal housing part all being connected in series such that the indicator means is activated when the safety member contacts the first wire.

2. A safety indicator as claimed in claim 1 wherein the first resilient wire has a coiled portion positioned to contact the safety member.

3. A safety indicator as claimed in claim 1 wherein said indicator means is a lamp.

4. A safety indicator as claimed in claim 1 wherein said alarm means is an audio alarm.

5. A safety indicator for a firearm having a stock of insulating material and a metal housing part in which an axially slidable metal safety button is positioned, said safety button being slidable between a release position in which the safety button is disengaged and an engaged position in which the safety button is engaged and contacts a portion of a trigger mechanism of the firearm such that it will not operate, comprising:

a battery for supplying electrical energy, said battery having first and second terminals and being located in a cavity in the stock of the firearm;

a safety release detector switch in the form of a first resilient wire with a flat coiled portion at its end which is in electrical contact with the safety member when the safety member is in the release position and is out of contact with the safety member when the safety member is in the engaged position, said wire being electrically connected to the first terminal of said battery;

an indicator lamp mounted on the firearm along an upper surface thereof, when in the normal horizontal firing position, said indicator lamp being connected between the second terminal of the battery and the metal housing part such that said lamp is turned on whenever the safety is in the release position;

a delay means connected across said indicator lamp for producing an electrical delay signal a predetermined period of time after said lamp is turned on; and a buzzer that is activated in response to the electrical delay signal.

* * * * *